United States Patent [19]

Bennett

[11] Patent Number: 4,711,354

[45] Date of Patent: Dec. 8, 1987

[54] ARTICLE DISPENSER FOR LIPSTICK OR THE LIKE

[75] Inventor: Robert Bennett, Easton, Conn.

[73] Assignee: KJS Industries, Inc., Marlboro, N.J.

[21] Appl. No.: 939,733

[22] Filed: Dec. 9, 1986

[51] Int. Cl.[4] ..... B65D 85/24

[52] U.S. Cl. ..... 206/385; 206/581; 206/306; 206/446; 132/79 A; 132/84 D

[58] Field of Search ..... 206/385, 45.34, 581, 206/306, 446, 212; 132/79 C, 79 A, 84 D, 88.7; 15/184

[56] References Cited

U.S. PATENT DOCUMENTS

| | | | |
|---|---|---|---|
| 580,013 | 4/1897 | Smith | 132/79 A |
| 860,527 | 7/1907 | Cochrane | 132/84 D |
| 1,200,925 | 10/1916 | Delamere et al. | 15/184 |
| 2,178,997 | 11/1939 | Mitchell | 139/79 A |
| 2,310,571 | 2/1943 | Brady | 15/184 |
| 2,454,718 | 11/1948 | Russo | 206/385 |
| 2,701,381 | 2/1955 | Lodewick et al. | 15/184 |
| 2,953,142 | 9/1960 | Clementson | 206/385 |
| 3,755,848 | 9/1973 | Mutrie | 15/184 |
| 4,471,874 | 9/1984 | Morane | 206/581 |

FOREIGN PATENT DOCUMENTS

| | | | |
|---|---|---|---|
| 1074371 | 3/1954 | France | 15/184 |

*Primary Examiner*—Stephen Marcus
*Assistant Examiner*—Brenda J. Ehrhardt

[57] ABSTRACT

A cosmetic dispenser including an elongated hollow cylindrical plastic container, closed at one end and open at the other end. An elongated plastic article is provided in the container. The article has an enlarged portion intermediate its ends. One end is coated with a cosmetic which extends toward but spaced away from the enlarged portion. The coated end is placed in the container but the enlarged portion is welded to the opening of the container. The uncoated end extends entirely outside of the container.

2 Claims, 7 Drawing Figures

ARTICLE DISPENSER FOR LIPSTICK OR THE LIKE

BACKGROUND OF THE INVENTION

Potential users of cosmetic articles, as for example lipsticks, do not want to purchase articles which are unsatisfactory for the individually desired usage. For example, a lipstick color as displayed on the individual lip stick may appear to be satisfactory before application, but may be found to be unsatisfactory when actually applied to the lips. It is of course possible for a potential user to purchase a lipstick and throw it away after one unsatisfactory application, but such action is obviously costly and undesirable.

A primary object of the present invention is to provide a dispenser containing a single article such as a plastic member having a colored lipstick coating at one end, whereby the article can be used for a single application and then thrown away. In other words, this type of dispenser can be used to provide an individual sample of a lipstick and, of course, different colors can be made available in different dispensers whereby a potential user can test any lipstick color without appreciable expense. Marketing organizations may test market different products by giving free samples to potential users.

SUMMARY OF THE INVENTION

An article dispenser, in accordance with the principles of the present invention, employs an elongated hollow plastic container which is closed at one end and has a circular opening having a first radius in the opposite end. A plastic article which can be an elongated plastic member cooperates with the container.

More particularly, the member has an enlargement intermediate its ends. The portion of the member between the enlargement and the one end is defined as a first section. The portion of the member between the enlargement and the opposite end is defined as a second section. The first section has a coating such as a lipstick coating which extends from the one end toward the enlargement but does not reach it. The enlargement has a spherical shape with a second radius only slightly smaller than the first radius. The first section is disposed in the container with the enlargement being in sealed engagement with the opening in the container, as for example being sonically welded thereto. The second section extends outside of the container whereby, when the container is held in place while the second section is rotated, the sonic weld can be broken and the article removed from the container. The user can then apply the coating and decide whether or not to use the coating subsequently as previously discussed.

The foregoing and other objects and advantages of the invention will either be explained or will become apparent to those skilled in the art when this specification is read in conjunction with the accompanying drawings.

DETAILED DESCRIPTION OF PREFERRED EMBODIMENTS

Figure 1:
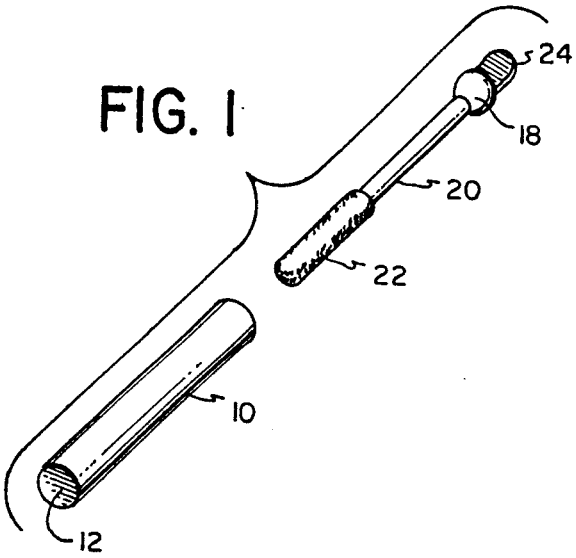
FIG. 1 is an exploded view of one embodiment of the invention.
Figure 2:
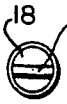
FIG. 2 is a top view of the embodiment of FIG. 1 in assembled position.
Figure 3:
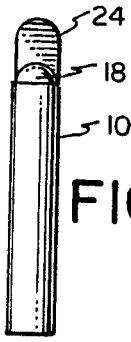
FIG. 3 is a side view of the structure of FIG. 2.
Figure 4:
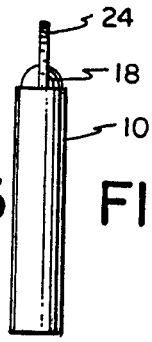
FIG. 4 is a view similar to that of FIG. 3 but rotated through an angle of ninety degrees.
Figure 5:
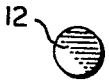
FIG. 5 is a bottom view of the structure of FIG. 2.
Figure 6:
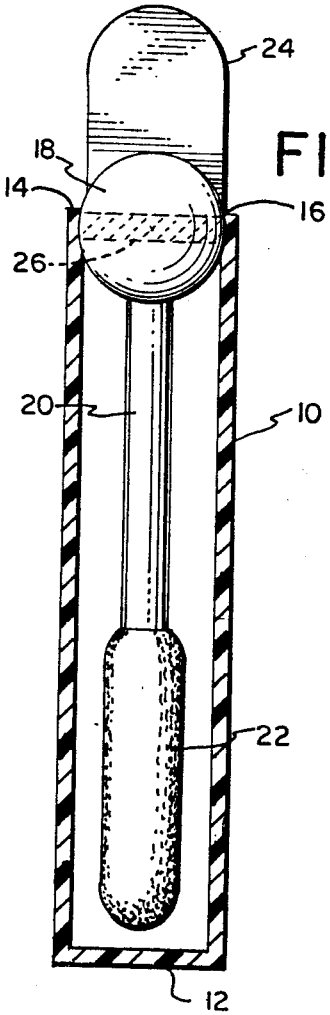
FIG. 6 is a cross sectional view of the embodiment of FIG. 1 in assembled position.

Referring now to FIGS. 1–7, there is shown an elongated hollow container in the form of a hollow plastic cylinder 10 having one end 12 closed and an opposite end 14 with a circular opening 16 having a first radius.

An article in the form of an elongated plastic member having a spherical enlargement 18 intermediate its ends. The enlargement 18 has a second radius very slightly smaller than the first radius. An elongated first section in the form of a rod of circular cross section 20 extends outward from one side of the enlargement in the direction of elongation. A coating such as a lipstick coating 22 covers the outer end of the first section and extends therealong toward, but does not reach the enlargement. A short flat thin section section 24 having in cross section the shape of a rectangle extends outward from the other side of the enlargement in the direction of elongation. The sections and enlargement constitute a single integral component.

The dispenser is assembled in a clean room so that the air in the cylinder is germ-free. The first section is inserted into the cylinder until the enlargement is in friction tight engagement with the opening and the enlargement and opening are sonically welded together in the region 26. The first section is spaced from the inner wall and the closed end of the cylinder.

Figure 7:
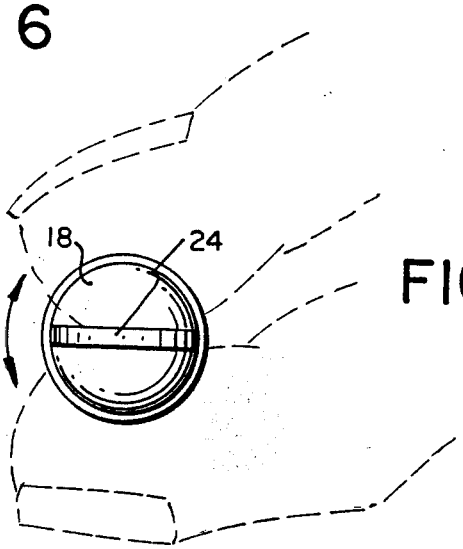
FIG. 7 illustrates the action of removing the article from the container.

FIG. 7 illustrates the step of opening the dispenser for use as previously described.

While preferred embodiments of the invention have been described above, it will be apparent to those skilled in the art that numerous modifications thereof can be made without departing from the invention as defined by the scope of the claims that follow.

What is claimed is:

1. An article dispenser comprising:

an elongated hollow cylindrical plastic container closed at one end and having an opening in the other end, the container having an inner wall, the opening in the other end being circular and having a first radius;

a plastic article consisting of an elongated plastic member having an enlargement intermediate its ends, the portion of the member between the one end and the enlargement being defined as a first section, the portion of the member between the enlargement and the other end being defined as a second section, the first section being a rod of generally circular cross section having a coating which extends from the one end toward, but spaced from the enlargement, the enlargement having a spherical shape with a second radius only slightly smaller than the first radius, the first section of the member extending into the container with the enlargement being in sonic weld sealed engagement with the opening in the other end of the container and being spaced from the wall and closed end of the container, the second section being thin and flat with a generally rectangular shape in cross section and extending entirely outside of the container whereby, when the container is held in place while the second section is rotated, the sonic weld breaks, permitting the article to be removed from the container.

2. The dispenser of claim 1 wherein the first section is relatively long and the second section is relatively short.

* * * * *